US005186535A

United States Patent [19]

Yokoyama

[11] Patent Number: 5,186,535

[45] Date of Patent: Feb. 16, 1993

[54] DEVICE FOR MOUNTING LAMP ON LAMP MOUNT

[75] Inventor: Takashi Yokoyama, Yokohama, Japan

[73] Assignee: Stanley Electric Co., Ltd., Tokyo, Japan

[21] Appl. No.: 772,842

[22] Filed: Oct. 8, 1991

[30] Foreign Application Priority Data

Oct. 15, 1990 [JP] Japan ..... 2-107895[U]

[51] Int. Cl.[5] ..... H01R 33/00

[52] U.S. Cl. ..... 362/226; 362/80; 362/396; 362/444

[58] Field of Search ..... 362/61, 80, 226, 396, 362/418, 440, 444, 457

[56] References Cited

U.S. PATENT DOCUMENTS

| | | | |
|---|---|---|---|
| 4,635,174 | 1/1987 | Montet | 362/61 |
| 4,670,822 | 6/1987 | Baker | 362/61 |
| 4,811,178 | 3/1989 | Ernst et al. | 362/61 |
| 4,922,388 | 5/1990 | Freudenreich | 362/61 |
| 4,933,819 | 6/1990 | Mohsakowski et al. | 362/61 |

*Primary Examiner*—Ira S. Lazarus
*Assistant Examiner*—Y. Quach
*Attorney, Agent, or Firm*—Frishauf, Holtz, Goodman & Woodward

[57] ABSTRACT

A device for mounting a lamp on a lamp mount includes an engagement spring made of a spring steel sheet in the form of a leaf spring having a substantially elliptical shape. The engagement spring is configured such that it extends at a right angle relative to the axis of a lamp socket, and moreover, it exhibits a line symmetry relative to two lines extending on a common plane at a right angle relative to each other. The common plane extends at a right angle relative to the axis of the lamp socket. The engagement spring includes an opposing pair of depressing portions and an opposing pair of arm-shaped engagement portions. The depressing portions extend in parallel with one of the two lines while maintaining a line symmetry relative to one of the two lines. The engagement portions are arranged in a spaced relationship while maintaining a line symmetry relative to other one of the two lines. When the engagement spring is placed in position on the upper surface of a lamp socket inserted through a socket insert hole, a uniform resilient depressing force is imparted to the lamp socket from the engagement spring so as to firmly hold the lamp socket on the lamp mount.

11 Claims, 2 Drawing Sheets

PRIOR ART

DEVICE FOR MOUNTING LAMP ON LAMP MOUNT

BACKGROUND OF THE INVENTION

1. Field of the Invention

The present invention relates to a device for mounting a lamp such as a front lamp for an automotive vehicle or the like on a lamp mount.

2. Description of the Related Art

To facilitate understanding of the present invention, a typical conventional device of the foregoing type will briefly be described below with reference to FIG. 3 and FIG. 4 which illustrate the prior art. As is best seen in FIG. 3, the conventional device is constructed such that a lamp socket 21 is first inserted into the socket insert hole 81 formed through a lamp mount 80 and an engagement spring 91 is brought in engagement with the lamp socket 21 to resiliently depress the same. The engagement spring 91 made of a material having excellent elasticity such as a spring steel wire is contoured in a substantially U-shaped configuration including an engagement portion 91*a*, a shank portion 91*b* and a depressing portion 91*c*, and the shank portion 91*b* is turnably mounted to turn about a hinge portion 82. With such construction, after the lamp socket 21 is inserted into the socket insert hole 81, the foremost end of the engagement portion 91*a* is engaged with a hook 83 on the lamp mount 80, whereby the lamp socket 21 is depressed from the rear side thereof under the effect of a resilient force derived from the engagement portion 91*a* and the depressing portion 91*c* so as to firmly hold the lamp socket 21 in the socket insert hole 81.

However, with respect to the conventional device constructed in the above-described manner, since a waterproofing packing 22 is fitted around the lamp socket 21 as shown in FIG. 4, the lamp socket 21 can not smoothly be inserted into the socket insert hole 81. In addition, since the engagement portion 91*a* and the depressing portion 91*c* are different from each other in structure, there is a tendency that a uniform depressing force is not imparted to the lamp socket 21. For this reason, there arises a malfunction that a lamp 20 is mounted on the lamp mount 80 in such an inclined state as shown in FIG. 4, resulting in light illuminating properties of the lamp 20 being degraded due to defocussing.

SUMMARY OF THE INVENTION

The present invention has been made in consideration of the foregoing background.

An object of the present invention is to provide a device for mounting a lamp on a lamp mount wherein a lamp socket is reliably inserted into a socket insert hole with a uniform depressing force imparted to the lamp socket.

Another object of the present invention is to provide a device for mounting a lamp on a lamp mount wherein the lamp can correctly be mounted on the lamp mount via a lamp socket without an occurrence of defocussing.

To accomplish the above objects, the present invention provides a device for mounting a lamp on a lamp mount wherein a lamp socket is inserted into a socket hole formed through the lamp mount so that the lamp socket is firmly held from the rear side thereof under the effect of a resilient force derived from an engagement spring, wherein the engagement spring is contoured such that it extends at a right angle relative to an axis of the lamp socket, and moreover, it exhibits a line symmetry relative to two lines extending on a common plane at a right angle relative to each other, the common plane extending at a right angle relative to the axis of the lamp socket.

It is preferable that the engagement spring is made of a spring steel sheet in the form of a leaf spring having a substantially elliptical shape.

The engagement spring includes an opposing pair of depressing portions adapted to depress the upper surface of the lamp socket when the engagement spring is placed in position on the lamp socket. The depressing portions extend in parallel with one of the two lines in the spaced relationship while maintaining a line symmetry relative to one of the two lines.

In addition, the engagement spring includes an opposing pair of arm-shaped engagement portions adapted to be engaged with hooks on the lamp mount when the engagement spring is placed in position on the lamp socket. The engagement portions are arranged in the spaced relationship while maintaining a line symmetry relative to other one of the two lines.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENT

Figure 1:
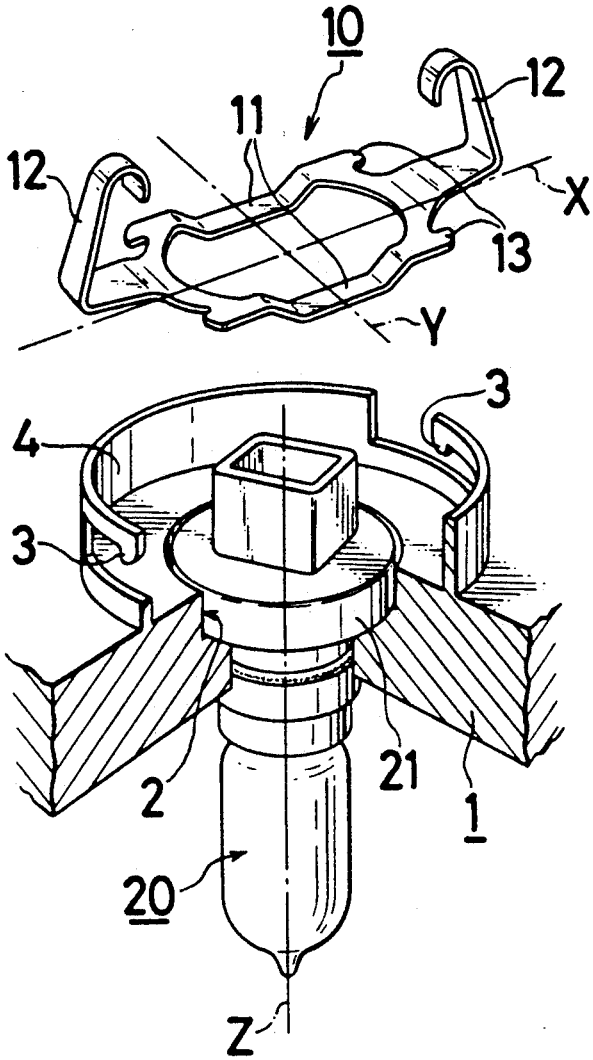
FIG. 1 is a partially exploded perspective view of a device for mounting a lamp on a lamp mount in accordance with an embodiment of the present invention.

Now, the present invention will be described in detail hereinafter with reference to FIG. 1 and FIG. 2 which illustrate the structure of a device for mounting a lamp on a lamp mount in accordance with a preferred embodiment of the present invention. It should be noted that same or similar components to those of the conventional device are represented by same reference numerals and repeated description is omitted for the purpose of simplification of description.

Figure 3:
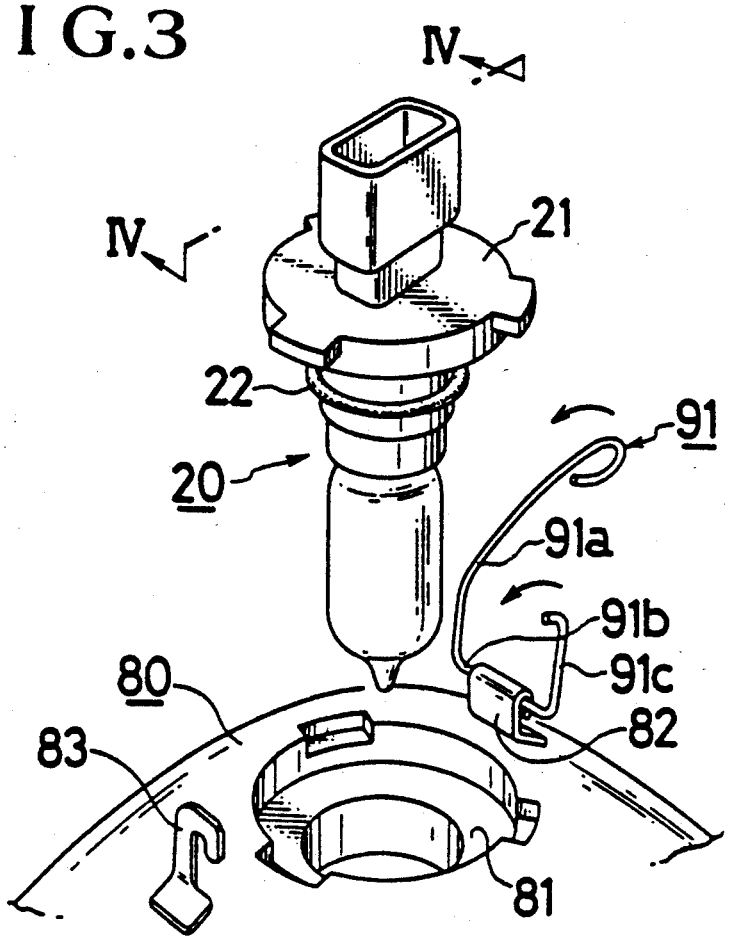
FIG. 3 is a perspective view of a conventional device for mounting a lamp on a lamp mount.
Figure 4:
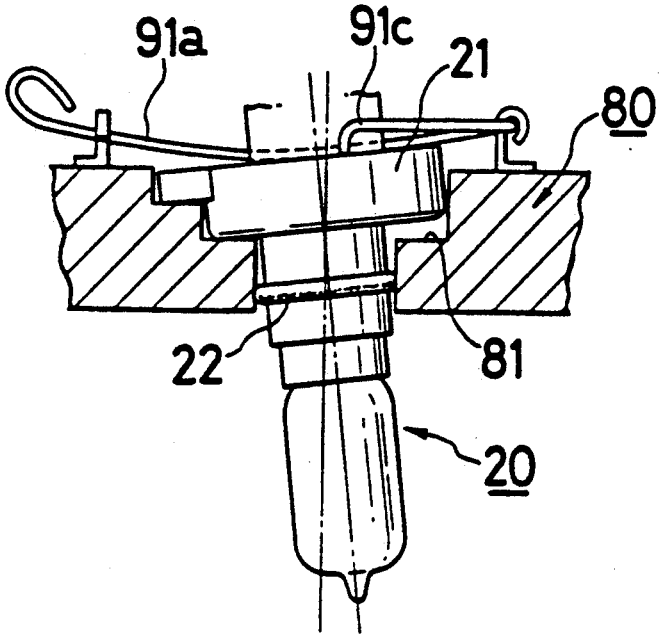
PRIOR ART FIG.4
FIG. 4 is a sectional view of the conventional device taken along line IV—IV in FIG. 3.

In FIG. 1, reference numeral 1 designates a lamp mount for, e.g., a front lamp mounted on an automotive vehicle. A socket insert hole 2 is formed through the lamp mount 1 so that a lamp socket 21 for a lamp 20 is inserted into the socket insert hole 2. Then, the lamp socket 21 is firmly mounted on the lamp mount 1 under the effect of a resilient force derived from an engagement spring 10 in the same manner as the conventional device. In contrast with the conventional device which has been described above with reference to FIG. 3 and FIG. 4, according to the present invention, the engagement spring 10 is configured such that it extends at a right angle relative to a Z-axis of the lamp 20 coincident with a center line of the lamp socket 21, i.e., a center line of the socket insert hole 2, and moreover, it exhibits a line symmetry relative to two lines, i.e., a X-line and a Y-line extending on a common plane at a right angle relative to each other.

Figure 2:
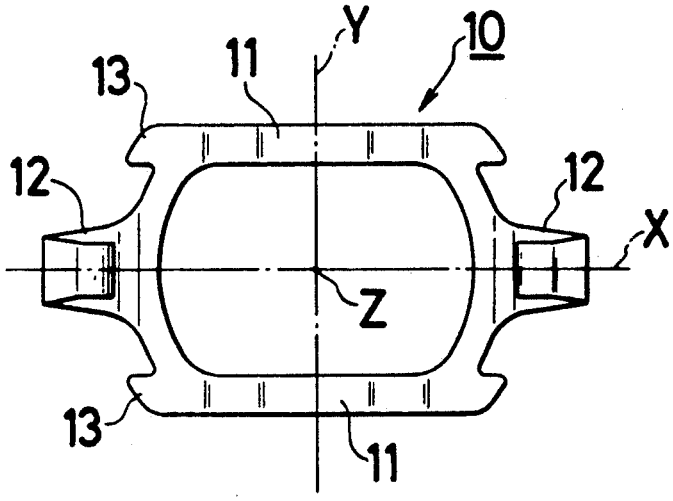
FIG. 2 is an enlarged plan view of an engagement spring which serves as an essential component for the device shown in FIG. 1.

FIG. 2 is an enlarged plan view which illustrates a substantially elliptical shape of the engagement spring 10 in more detail. As is apparent from the drawing, the engagement spring 10, made of a material having excellent elasticity such as a spring steel sheet exhibits a line symmetry not only relative to the X-line but also relative to the Y-line. In addition, the engagement spring 10 includes as essential components an opposing pair of depressing portions 11 for resiliently depressing the lamp socket 21 and an opposing pair of arm-shaped engagement portions 12 arranged outside of the depressing portions 11 at symmetrical positions relative to the depressing portions 11.

Next, the engagement portions 12 will be described in more detail below. To maintain a line symmetry relative to the Y-line, the engagement portions 12 are configured to exhibit a same shape having a line symmetry relative to the Y-line.

According to the present invention, since each of the engagement portions 12 has a same symmetrical shape as mentioned above, the engagement portions 12 exhibit a same functional effect for correctly mounting the lamp 20 on the lamp mount 1. To this end, an opposing pair of hooks 3 are formed on an annular position-restricting rib 4 at positions peripheral to the socket insert hole 2 so as to allow the engagement portions 12 to be engaged with the hooks 3 (see FIG. 1). It is obvious that the hooks 3 are located in a symmetrical relationship relative to the axis Z of the socket insert hole 2.

In FIG. 2, reference numeral 13 designates a position-restricting pawl. Four position-restricting pawls 13 are arranged at four corners of spring 10 such that the annular position-restricting rib 4 comes in engagement with their apexes. With such construction, the position where the engagement spring 10 is placed on the lamp socket 21 can exactly be determined when the engagement portions 12 are engaged with the hooks 3 while the position-restricting pawls 13 come into engagement with the position-restricting rib 4.

As described above, according to the present invention, since the engagement spring 10 is configured such that it extends at a right angle relative to the Z-axis of the lamp 20 coincident with the center line of the socket insert hole 2, and moreover, it exhibits a line symmetry relative to two lines, i.e., the line X and the line Y extending on a common plane at a right angle relative to each other, a uniform depressing force is imparted to the lamp socket 21 when the engagement spring 10 is mounted on the lamp socket 21 such that the lamp socket 21 is depressed by the resilient depressing portions 11 while the engagement portions 12 are engaged with the hooks 3. In contrast with the conventional device, since the lamp 20 is mounted on the lamp mount 1 without undesirable inclination of the lamp 20 relative to the lamp mount 1 attributable to arrangement of, e.g., a packing, the lamp 20 is mounted on the lamp mount 1 while maintaining an exact focus position where light is irradiated from the lamp 20 with correct illuminating properties.

While the present invention has been described above only with respect to a single preferred embodiment thereof, it should of course be understood that the present invention should not be limited only to this but various changes or modifications may be made without departure from the scope of the invention defined by the appended claims.

What is claimed is:

1. In a device for mounting a lamp on a lamp mount, wherein a lamp socket is inserted into a socket hole formed through said lamp mount so that said lamp socket is firmly held from a rear side thereof by means of a resilient force derived from an engagement spring, the improvement wherein:

said engagement spring is configured such that it extends at a right angle relative to an axis of said lamp socket; and said engagement spring exhibits a line symmetry relative to two lines extending on a common plane at a right angle relative to each other, said common plane extending at a right angle relative to said axis of said lamp socket, and said two lines intersecting along said axis of said lamp socket.

2. The device as claimed in claim 1, wherein said engagement spring comprises a resilient leaf spring having a substantially elliptical shape.

3. The device as claimed in claim 1, wherein said engagement spring includes an opposing pair of spaced apart depressing portions for depressing an upper surface of said lamp socket when said engagement spring is placed in position on the lamp socket, said depressing portions extending in parallel with one of said two lines in a spaced relationship while maintaining a line symmetry relative to one of said two lines.

4. The device as claimed in claim 1, wherein said engagement spring includes an opposing pair of spaced apart arm-shaped engagement portions adapted to be engaged with hooks on the lamp mount when said engagement spring is placed in position on said lamp socket, said arm-shaped engagement portions being arranged in a spaced relationship while maintaining a line symmetry relative to the other one of said two lines.

5. The device as claimed in claim 4, wherein:

the lamp mount includes an annular position-restricting rib integrated with the lamp mount; and said hooks are formed on said annular position-restricting rib integrated with the lamp mount.

6. The device as claimed in claim 5, wherein said annular position-restricting rib comprises a substantially circular projecting extending from the lamp mount, said circular projection having means defining said hooks thereon.

7. The device as claimed in claim 4, wherein said arm-shaped engagement portions are resilient.

8. The device as claimed in claim 1, wherein said engagement spring comprises respective resilient depressed portions thereon.

9. The device as claimed in claim 8, wherein said resilient depressed portions of said engagement spring are located on opposite sides of said engagement spring.

10. In a device for mounting a lamp on a lamp mount, wherein a lamp socket is inserted into a socket hole formed through said lamp mount so that said lamp socket is firmly held from a rear side thereof by means of a resilient force derived from an engagement spring, the improvement wherein:

said engagement spring is configured such that it extends at a right angle relative to an axis of said lamp socket;

said engagement spring exhibits a line symmetry relative to two lines extending on a common plane at a right angle relative to each other, said common plane extending at a right angle relative to said axis of said lamp socket;

the lamp mount includes an annular position-restricting rib integrated with the lamp mount;

said engagement spring includes an opposing pair of spaced apart arm-shaped engagement portions adapted to be engaged with hooks formed on said annular position-restricting rib integrated with the lamp mount when said engagement spring is placed in position on said lamp socket, said arm-shaped engagement portions being arranged in a spaced relationship while maintaining a line symmetry relative to one of said two lines; and said engagement spring includes four position-restricting pawls at four corner areas thereof, said four position-restricting pawls being engageable with said annular position-restricting rib when said engagement spring is placed in position on said lamp socket.

11. In a device for mounting a lamp on a lamp mount, wherein a lamp socket is inserted into a socket hole formed through said lamp mount so that said lamp socket is firmly held from a rear side thereof by means of a resilient force derived from an engagement spring, the improvement wherein:

said engagement spring is configured such that it extends at a right angle relative to an axis of said lamp socket;

said engagement spring exhibits a line symmetry relative to two lines extending on a common plane at a right angle relative to each other, said common plane extending at a right angle relative to said axis of said lamp socket;

said engagement spring includes an opposing pair of spaced apart arm-shaped engagement portions adapted to be engaged with hooks on the lamp mount when said engagement spring is placed in position on said lamp socket, said arm-shaped engagement portions being arranged in a spaced relationship while maintaining a line symmetry relative to one of said two lines; and said arm-shaped engagement portions comprise resilient members projecting substantially perpendicularly from said common plane.

* * * * *